US007446726B2

(12) United States Patent
Hasegawa et al.

(10) Patent No.: US 7,446,726 B2
(45) Date of Patent: Nov. 4, 2008

(54) ANTENNA

(75) Inventors: Minoru Hasegawa, Yokohama (JP); Takao Shimamori, Yokohama (JP); Yong-Jin Kim, Seoul (KR); Do-Hoon Kwon, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/020,833

(22) Filed: Dec. 23, 2004

(65) Prior Publication Data

US 2005/0168398 A1 Aug. 4, 2005

(30) Foreign Application Priority Data

Dec. 25, 2003 (JP) ..... 2003-428649
Oct. 5, 2004 (KR) ..... 10-2004-0079080

(51) Int. Cl.
*H01Q 9/16* (2006.01)
*H01Q 1/38* (2006.01)

(52) U.S. Cl. ..... 343/793; 343/700 MS

(58) Field of Classification Search ..... 343/700 MS, 343/702, 846, 848, 793
See application file for complete search history.

(56) References Cited

U.S. PATENT DOCUMENTS

| | | | | |
|---|---|---|---|---|
| 2,785,396 | A | 3/1957 | Carter | 343/741 |
| 4,121,219 | A | 10/1978 | O'Connor | 343/741 |
| 2003/0214444 | A1 | 11/2003 | Asai et al. | 343/700 MS |
| 2005/0248487 | A1 * | 11/2005 | Okado | 343/700 MS |

FOREIGN PATENT DOCUMENTS

| | | |
|---|---|---|
| EP | 0 766 343 | 4/1997 |
| JP | 08-102611 | 4/1996 |
| JP | 2001-217636 | 8/2001 |
| JP | 2002-164731 | 6/2002 |
| JP | 2003-273638 | 9/2003 |

OTHER PUBLICATIONS

Ramirez et al., "Reduced Size Single and Dual-Band Diversity Antennas for Portable Devices", 2001 IEEE, pp. 1155-1158.

* cited by examiner

*Primary Examiner*—Shih-Chao Chen
(74) *Attorney, Agent, or Firm*—McNeely Bodendorf LLP

(57) ABSTRACT

Disclosed herein is an antenna that can be manufactured in a smaller size and can achieve good wideband characteristics. The antenna includes a substantially semicircular antenna component installed in a monopole or dipole structure. Power is supplied to an end of the diameter of the antenna component.

20 Claims, 8 Drawing Sheets

ANTENNA

PRIORITY

This application claims priority under 35 U.S.C. § 119 to an application entitled "Antenna" filed in the Japanese Property Office on Dec. 25, 2003 and assigned Serial No. 2003-428649, and an application entitled "Antenna" filed in the Korean Intellectual Property Office on Oct. 5, 2004 and assigned Serial No. 2004-79080, the contents of both of which are incorporated herein by reference.

BACKGROUND OF THE INVENTION

1. Field of the Invention

The present invention relates to an antenna for a portable communication device.

2. Description of the Related Art

It is known that a circular disc monopole antenna using a circular antenna component obtains wideband characteristics. A circular disc monopole antenna having a circular antenna component modified for miniaturization is disclosed in Japan Patent Laid-Open Publication No. 2002-164731, which discloses the circular antenna component bent perpendicularly with respect to its diameter.

In conventional portable communication devices, however, the antenna component occupies a large area and the antenna needs to be further scaled down. For example, there is very limited room for securing an antenna in small communication devices. Thus, small-size antennas are required.

Moreover, the use of a conventional modified circular antenna component causes an anti-resonant point in a desired frequency band, thereby deteriorating Voltage Standing Wave Ratio (VSWR) characteristics and making it difficult to maintain constant wideband characteristics.

SUMMARY OF THE INVENTION

An object of the present invention is to substantially solve at least the above problems and/or disadvantages and to provide at least the advantages below. Accordingly, an object of the present invention is to provide an antenna which obtains good wideband characteristics and can be scaled down to a smaller size.

The above object is achieved by providing an antenna that can be made in a smaller size and can achieve good wideband characteristics. The antenna includes a substantially semicircular antenna component in a monopole or dipole structure. Power is supplied to an end of the diameter of the antenna component. Preferably, the semicircular antenna component has a diameter of a quarter of resonant wavelength λ. Further, the semicircular antenna component is preferably provided with a slit for adjusting an impedance bandwidth of the antenna.

In another aspect of the present invention, an antenna of the present invention includes a dielectric plate and a semicircular conductive component fixedly mounted on the dielectric plate. The dielectric plate is preferably made of ceramic. Further, the semicircular conductive component preferably has a diameter of a quarter of a resonant wavelength λ.

Preferably, the dielectric plate has a rectangular shape, with one side adjacent to a straight side of the semicircular conductive component.

Preferably, the antenna further includes a ground plate fixedly connected to the dielectric plate.

BRIEF DESCRIPTION OF THE DRAWINGS

The above and other objects, features and advantages of the present invention will become more apparent from the following detailed description when taken in conjunction with the accompanying drawings in which:

FIGS. 6A to 6C illustrate antenna configurations corresponding to curves A, B and C illustrated in FIG. 5, wherein FIG. 6B is a conventional antenna configuration that corresponds to curve B of FIG. 5.

DETAILED DESCRIPTION OF THE PREFERRED EMBODIMENTS

Preferred embodiments of the present invention will be described herein below with reference to the accompanying drawings. In the following description, well-known functions or constructions are not described in detail to avoid obscuring the invention with unnecessary detail.

Figure 1:
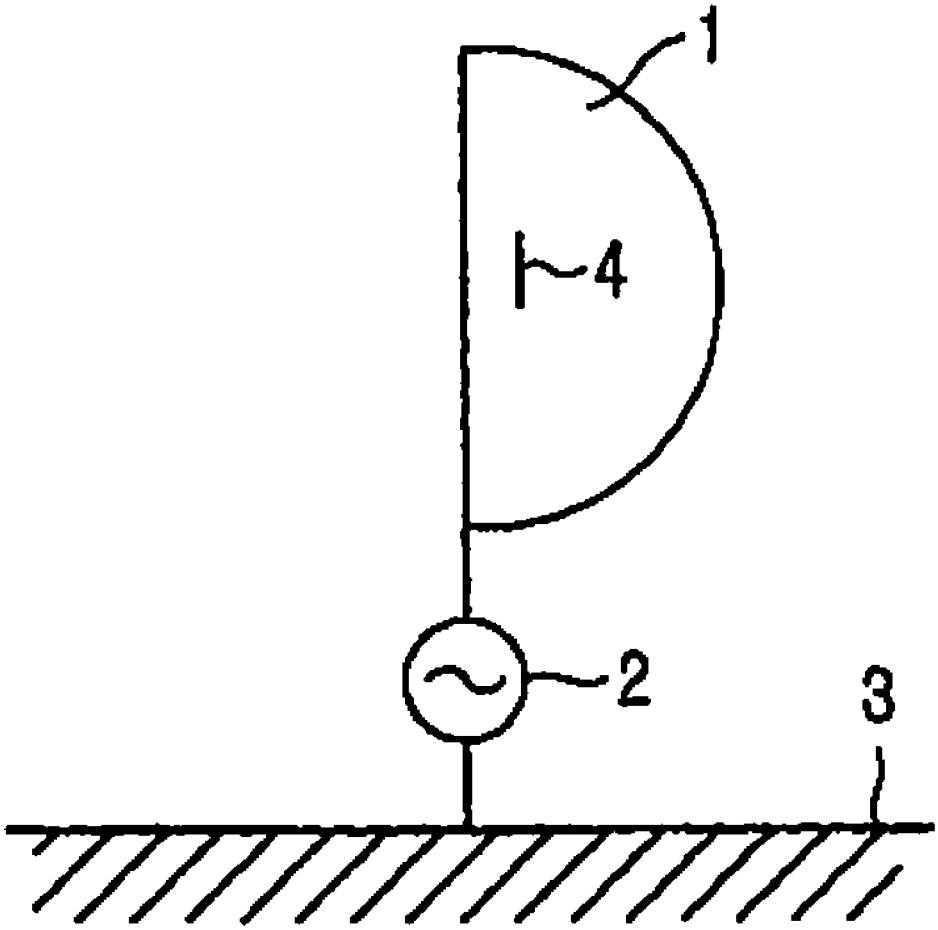
FIG. 1 is a side view of an antenna according to a first embodiment of the present invention.

FIG. 1 is a side view illustrating the configuration of an antenna according to a first embodiment of the present invention. A substantially semicircular antenna component 1 is assembled in a monopole structure.

Figure 2A:
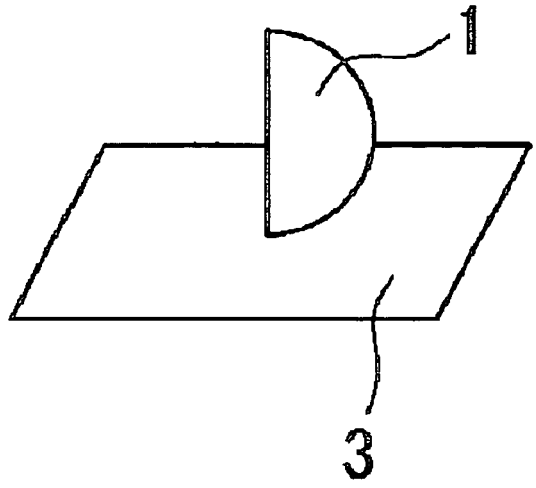
FIGS. 2A and 2B are exemplary layouts of antenna components according to the first embodiment of the present invention.
Figure 2B:
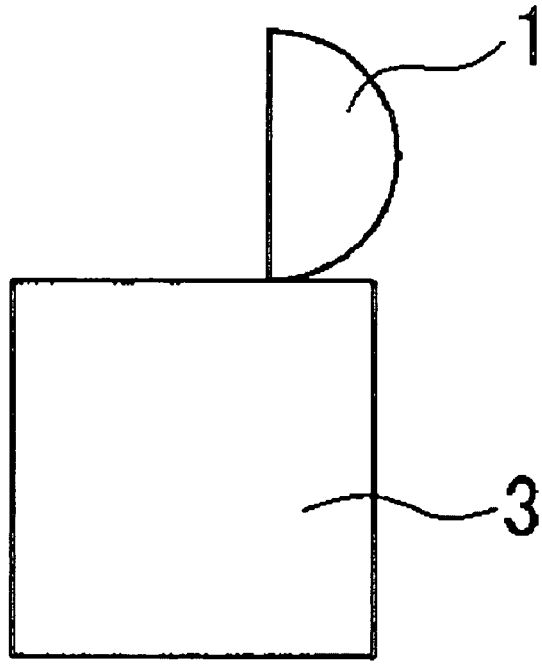

Referring to FIG. 1, the antenna component 1 is a semicircular conductive disc. Its diameter is preferably about a quarter of the resonant wavelength λ of the antenna. As illustrated in FIG. 2A, the antenna component 1 can be installed with its diameter perpendicular to a ground plane 3. Alternatively, the antenna component 1 can be installed in parallel with the ground plane 3, as illustrated in FIG. 2B. A substantially semicircular shape suffices for the conductive disc of the antenna component 1. For example, the antenna component 1 can be semi-oval. A stub member (not shown) can be added around the outer circumference of the antenna component 1.

As shown in FIG. 2B, the ground plate 3 preferably is rectangular in shape, and has one side adjacent to a straight, tangential line of a side of the semicircular antenna 1.

A power supply 2, as shown in FIG. 1, supplies power to the antenna component 1. The power supply 2 is connected between an end of the diameter of the antenna component 1 and the ground plane 3. The semicircular antenna component 1 can be provided with a slit 4 for adjusting an impedance bandwidth of the antenna.

In the above configuration, since the antenna component 1 is substantially semicircular, it occupies a smaller area. Also, forming the antenna component 1 as a substantially semicircular conductive disc prevents generation of an anti-resonant point in a desired frequency band, thereby resulting in good wideband characteristics.

An antenna according to another embodiment of the present invention will be described below.

Figure 3:
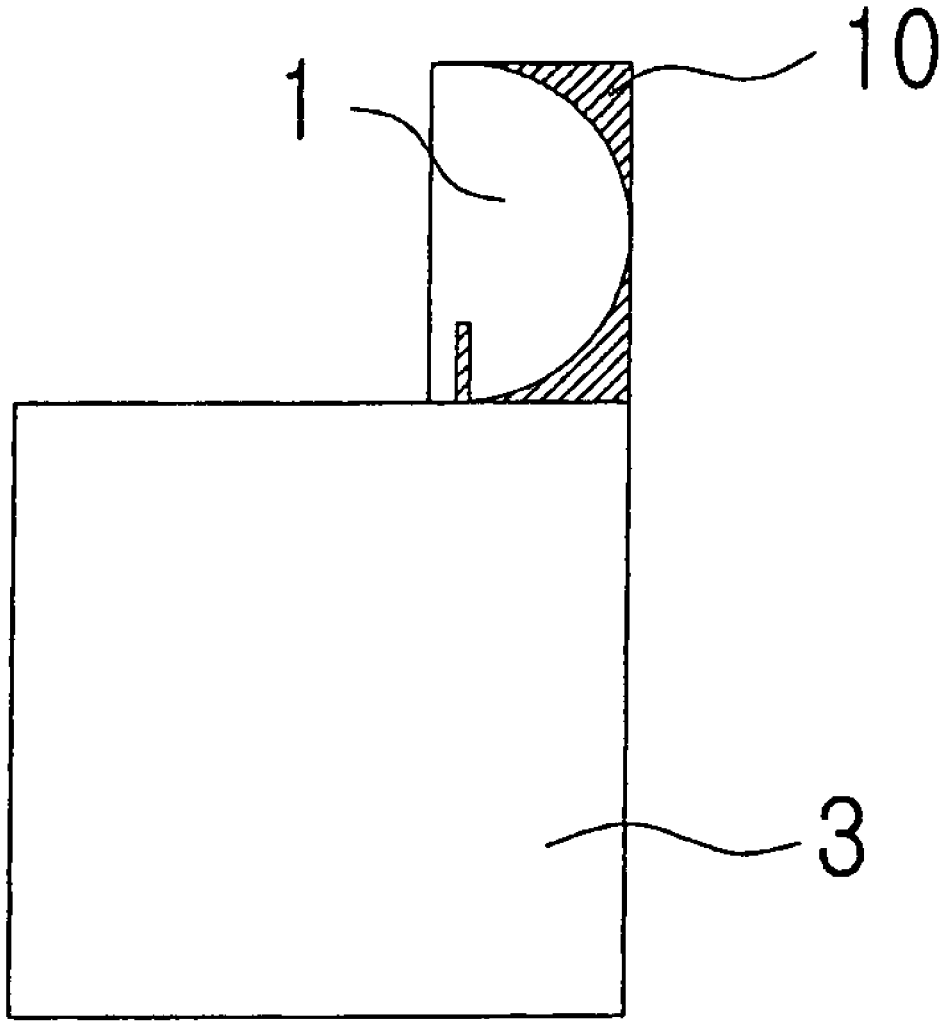
FIG. 3 is a side view of an antenna according to a second embodiment of the present invention.
Figure 4:
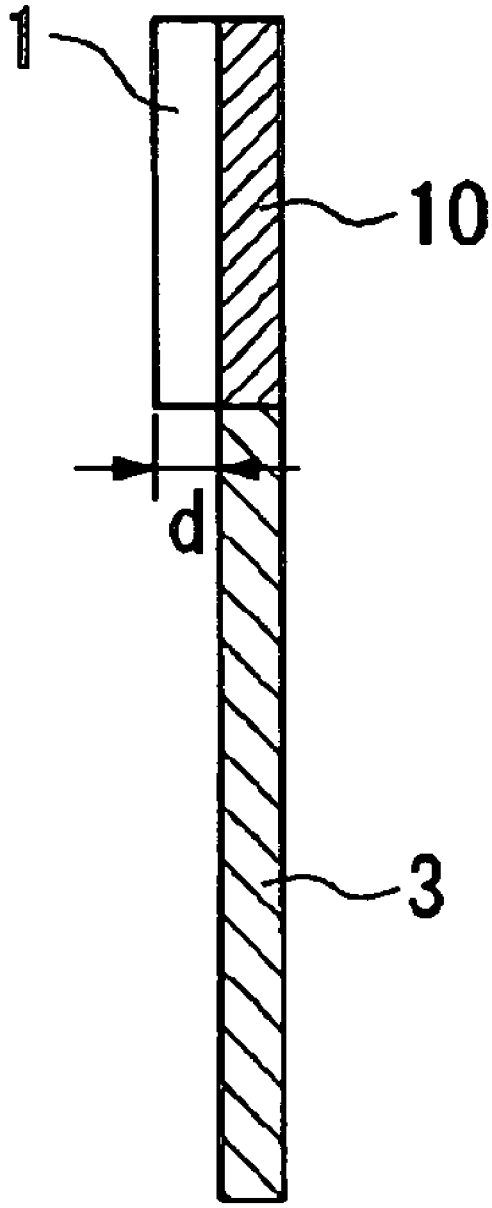
FIG. 4 illustrates an exemplary layout of antenna components according to the second embodiment of the present invention.

FIG. 3 is a side view illustrating an antenna according to a second embodiment of the present invention. Referring to FIG. 3, the substantially semicircular antenna component 1 is formed on a dielectric plate 10. The dielectric plate 10 is, for example, a ceramic, and enables miniaturization of the antenna. As illustrated in FIG. 4, the antenna component 1 can be installed with an offset distance "d" with respect to the ground plane 3. The semicircular antenna component is preferably provided with a slit for adjusting an impedance bandwidth of the antenna.

Figure 5:
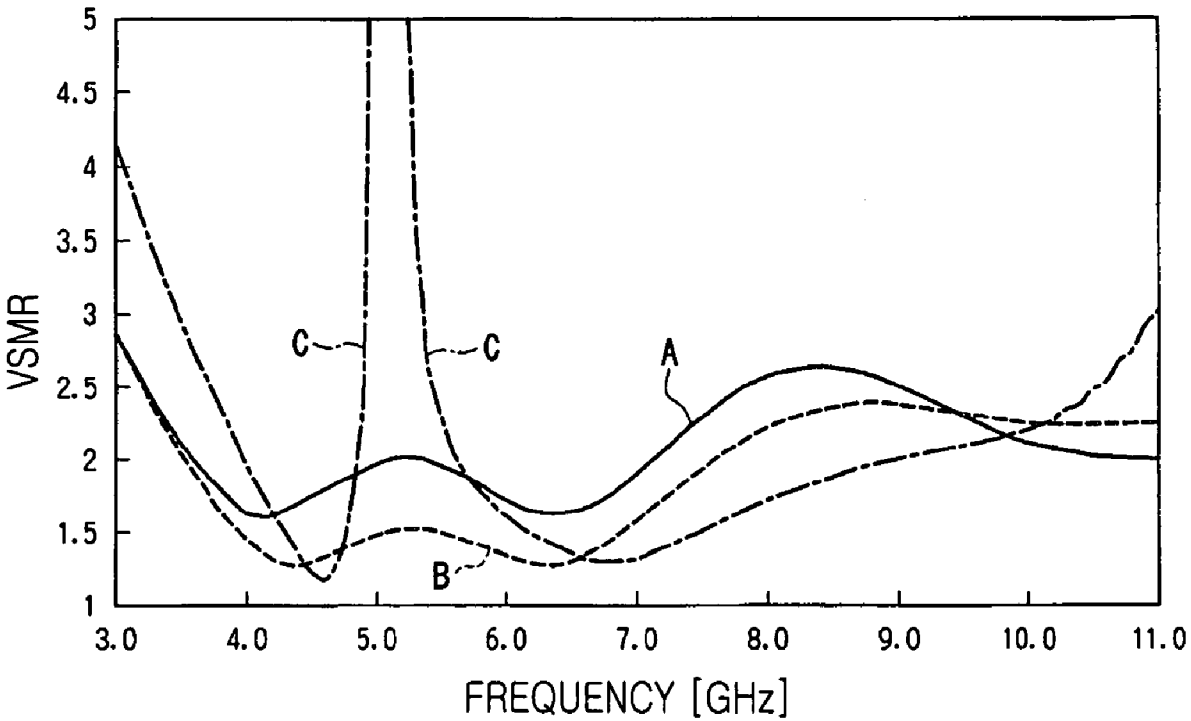
FIG. 5 is a graph illustrating the improvement of VSWR characteristics in the antenna according to the present invention.

FIG. 5 is a graph illustrating the improvement of VSWR characteristics of the antenna according to the present invention.

Figure 6A:
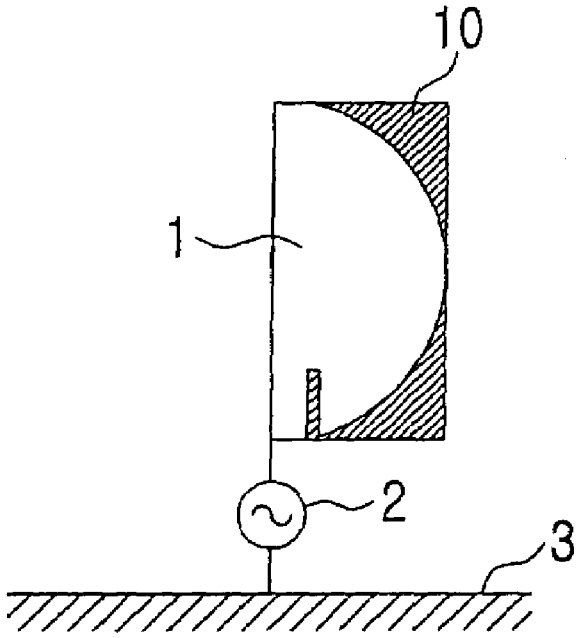
Figure 6B:
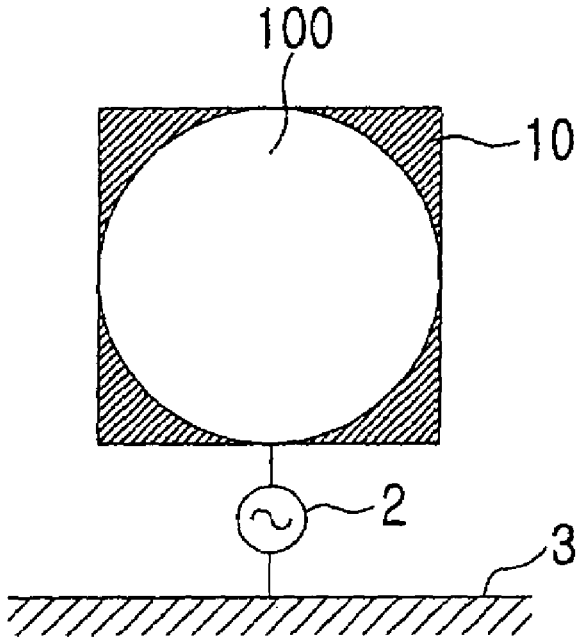
FIG.6B PRIOR ART

Referring to FIG. 5, curve "A" denotes a simulation result of an antenna illustrated in FIG. 6A, which has the semicircular antenna component 1 formed on the dielectric plate 10. Curve "B" denotes a simulation result of a conventional circular disc monopole antenna illustrated in FIG. 6B. The conventional antenna has a circular antenna component 100 formed on the dielectric plate 10.

Figure 6C:
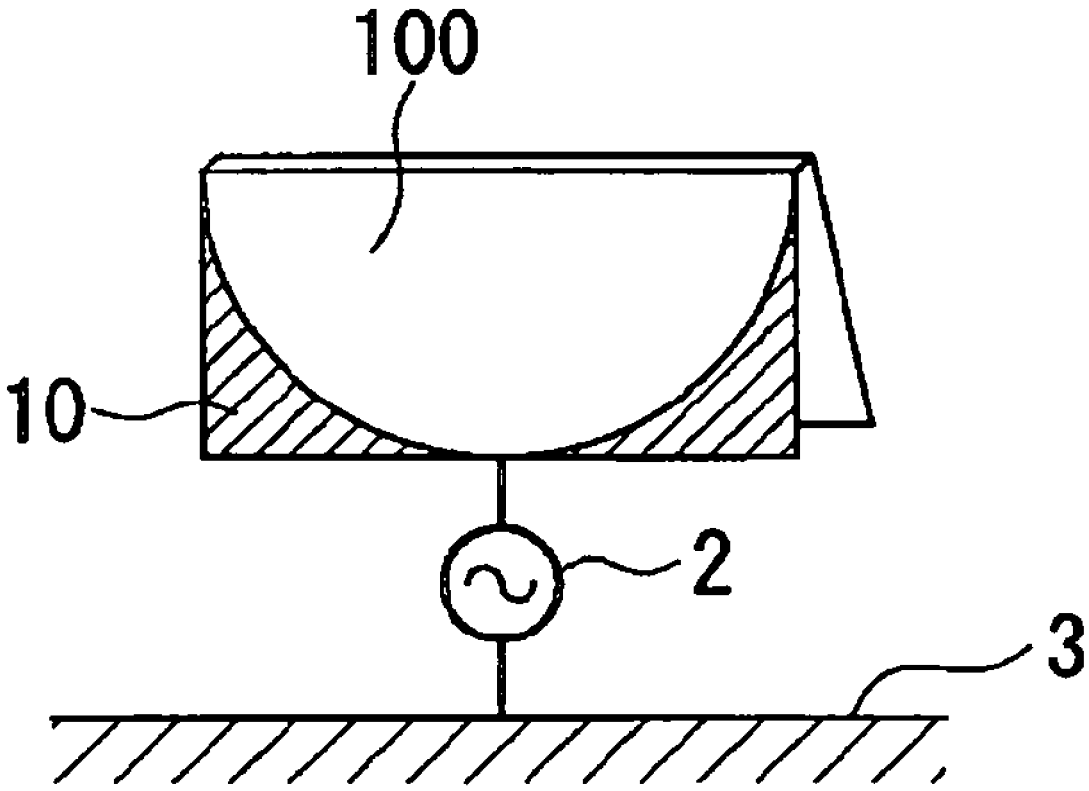

Curve "C" denotes a simulation result of a semicircular monopole antenna illustrated in FIG. 6C. This antenna is produced by bending a circular disc to a semicircular shape. Thus, the antenna has the semicircular antenna component 100 preferably shaped into a sideward "U" shape (i.e. ""ㄷ""), formed on the dielectric plate 10.

Curve "C" indicates an anti-resonant point generated in the vicinity of 5.1 GHz. Therefore, good VSWR characteristics cannot be expected from the bent semicircular monopole antenna. Also, the antenna component 100 is bent so as to be of the same shape on its front and rear surfaces, such as illustrated in FIG. 6A. Hence, current flows with opposite phases through the front and rear surfaces of the antenna component 100. As a result, a frequency band is created whose loss increases due to factors including the material of the dielectric plate 10, thereby reducing radiation efficiency.

Meanwhile, the inventive antenna denoted by curve "A" does not have, on the average, as good VSWR characteristics as the conventional circular disc monopole antenna denoted by curve "B". However, the inventive antenna does not create an anti-resonant point. Considering the tradeoff relation between the area of the antenna and its performance, the inventive antenna can be said to have satisfactory VSWR characteristics.

Figure 7A:
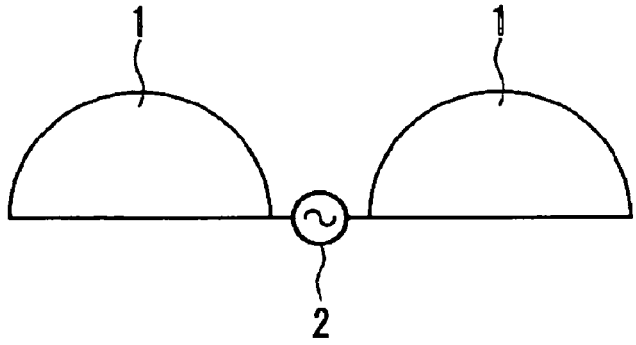
FIGS. 7A and 7B are side views illustrating a dipole antenna according to the present invention.
Figure 7B:
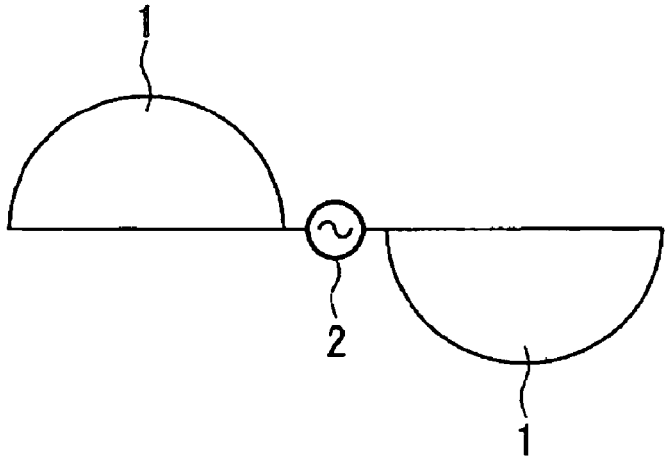

While the invention has been shown and described with reference to certain preferred embodiments thereof, they are merely exemplary applications. For example, the present invention is also applicable to a dipole antenna. The term "dipole" will also be recognized to cover "cross dipole" antennas. FIGS. 7A and 7B are side views of a dipole antenna according to the present invention.

Referring to FIGS. 7A and 7B, two semicircular antenna components 1 are assembled in a dipole structure. The antenna components 1 face in the same direction in FIG. 7A, and face in different directions in FIG. 7B.

In accordance with the present invention as described above, the area that an antenna component occupies can be reduced by shaping the antenna component to be substantially semicircular. Furthermore, this arrangement avoids an anti-resonant point in a desired frequency band, thereby achieving good wideband characteristics.

Thus, it will be understood by those skilled in the art that various changes in form and details may be made therein without departing from the spirit and scope of the invention as defined by the appended claims.

What is claimed is:

1. An antenna comprising:

two substantially semicircular antenna components installed in a dipole structure without folding, wherein power is supplied between ends of diameters of the antenna components.

2. The antenna of claim 1, wherein the semicircular antenna components are formed on a dielectric plate.

3. The antenna of claim 1, wherein the semicircular antenna components have a diameter of a quarter of a resonant wavelength λ.

4. The antenna of claim 1, wherein the semicircular antenna components are provided with a slit for adjusting an impedance bandwidth of the antenna.

5. The antenna of claim 1, wherein the semicircular antenna components are fixedly mounted on a dielectric plate.

6. The antenna of claim 5, wherein the dielectric plate is made of ceramic.

7. The antenna of claim 5, wherein the semicircular antenna components have a diameter of a quarter of a resonant wavelength λ.

8. The antenna of claim 5 wherein the dielectric plate has a rectangular shape, and one side adjacent to a tangential line of a side of the semicircular antenna components.

9. The antenna of claim 5, further comprising a ground plate fixedly connected to the dielectric plate.

10. The antenna of claim 5, wherein the semicircular antenna components are provided with a slit for adjusting an impedance bandwidth.

11. The antenna of claim 5, wherein the antenna prevents generation of an anti-resonant point in a desired frequency band.

12. The antenna of claim 5, wherein the diameters of the semicircular antenna components are perpendicular to a ground plane.

13. The antenna of claim 12, wherein the antenna prevents generation of an anti-resonant point in a desired frequency band.

14. The antenna of claim 5, wherein the diameters of the semicircular antenna components are parallel to a ground plane.

15. The antenna of claim 14, wherein the antenna prevents generation of an anti-resonant point in a desired frequency band.

16. The antenna of claim 1, wherein the antenna prevents generation of an anti-resonant point in a desired frequency band.

17. The antenna of claim 1, wherein the antenna is substantially flat, and the diameters of the semicircular antenna components are perpendicular to a ground plane.

18. The antenna of claim 17, wherein the antenna prevents generation of an anti-resonant point in a desired frequency band.

19. The antenna of claim 1, wherein the antenna is substantially flat, and the diameters of the semicircular antenna components are parallel to a ground plane.

20. The antenna of claim 19, wherein the antenna prevents generation of an anti-resonant point in a desired frequency band.

* * * * *